United States Patent [19]

Russell

[11] 4,258,858

[45] Mar. 31, 1981

[54] APPARATUS FOR SEALING FLOATING ROOF TANKS

[76] Inventor: Robert L. Russell, Costa Mesa, Calif.

[21] Appl. No.: 55,825

[22] Filed: Jul. 9, 1979

[51] Int. Cl.[3] ..... B65D 87/18

[52] U.S. Cl. ..... 220/222; 220/218

[58] Field of Search ..... 220/216, 221, 222, 218

[56] References Cited

U.S. PATENT DOCUMENTS

| | | | |
|---|---|---|---|
| 1,668,792 | 5/1928 | Wiggins | 220/222 |
| 1,775,758 | 9/1930 | George | 220/222 |
| 1,777,560 | 10/1930 | Griffin | 220/218 |
| 1,867,845 | 7/1932 | Kimbell | 220/222 |
| 2,563,016 | 8/1951 | Feild | 220/225 |
| 3,589,549 | 6/1971 | Heisterberg | 220/222 |
| 4,099,644 | 7/1978 | Nuttall et al. | 220/225 |
| 4,116,356 | 9/1978 | Silver, Jr. et al. | 220/85 R |

OTHER PUBLICATIONS

Chicago Bridge & Iron Co., Metallic Sealing Ring Emission Test Program, 1/77.

*Primary Examiner*—Steven M. Pollard

*Attorney, Agent, or Firm*—Dean Sandford; Daniel R. Farrell; Alan H. Thompson

[57] ABSTRACT

An apparatus for sealing floating roof tanks including a sealing element disposed around the circumference of the floating roof between the floating roof and the tank wall, and a plurality of baffles adapted to substantially inhibit or prevent the circumferential flow of vapors through a vapor space between the sealing element and the body of stored volatile liquid.

15 Claims, 4 Drawing Figures

APPARATUS FOR SEALING FLOATING ROOF TANKS

BACKGROUND OF THE INVENTION

1. Field of the Invention

This invention relates to storage tanks suitable for storing volatile liquids, such as volatile hydrocarbon liquids, and in particular to floating roof tanks and apparatus for sealing the circumferential space between the floating roof and the tank wall.

2. Description of the Prior Art

The use of floating roof tanks for the storage of volatile liquids, such as crude oil, petroleum products and the like, has been widely accepted due to the reduced vapor emissions and improved safety features of floating roof tanks as compared to fixed roof tanks. Floating roof tanks typically have a sealing element disposed in the annular space between the floating roof and the tank wall in order to close this annular space while permitting normal roof movement due to filling and emptying of the tank as well as diurnal expansion and contraction of the stored liquid. The sealing element also serves to keep the floating roof centered in the tank.

The sealing elements currently employed on floating roof tanks include toroidal sealing elements and shoe-type sealing elements, each of which can be used alone or in combination with a secondary seal, such as a wiper sealing element. While these prior art sealing elements are relatively effective in reducing the vapor emissions from floating roof tanks, the very strict requirements of recent governmental regulations and the increasing value of volatile liquids, such as gasoline, have combined to render objectionable even the relatively small vapor emissions from these tanks. Thus a need exists for an improved apparatus for sealing floating roof tanks.

Accordingly, a primary object of this invention is to provide an improved sealing apparatus for floating roof tanks.

Another object of this invention is to provide a simple and effective apparatus for reducing vapor emissions from floating roof tanks.

Yet another object of this invention is to provide an improved sealing apparatus which can be easily assembled from readily available components.

Still other objects, advantages and features of this invention will become apparent to those skilled in the art from the following description when taken in conjunction with the accompanying drawings.

SUMMARY OF THE INVENTION

Briefly, this invention provides an improved apparatus for sealing the annular space around the circumference of a floating roof between the roof and the wall of a floating roof tank. The apparatus includes (1) a sealing element coupled to the roof and adapted to substantially completely seal the annular space between the roof and the tank walls, and (2) a plurality of baffles disposed in a vapor space between the sealing element and the stored liquid, which baffles are adapted to substantially inhibit or prevent the flow of vapors through the vapor space around the circumference of the floating roof.

The apparatus of this invention can be used to substantially reduce vapor emissions from all floating roof tanks, and is capable of further reducing even the relatively low vapor emissions from floating roof tanks having conventional seals which meet all current governmental regulations. Additionally, conventional sealing elements on existing tanks can be readily converted to the sealing apparatus of this invention.

BRIEF DESCRIPTION OF THE DRAWINGS

The invention will be more readily understood by reference to the drawings, wherein like numerals refer to like elements, and in which.

DETAILED DESCRIPTION OF THE INVENTION

Vapor emissions from floating roof tanks are currently a matter of concern and a variety of governmental regulations have been promulgated in an attempt to reduce such emissions. Typically these regulations limit the maximum sizes of various "gaps" between the sealing apparatus and the tank wall. It has been discovered, however, that significant amounts of vapors are emitted from conventional floating roof tanks under windy conditions even when the tanks are in full compliance with the maximum gap requirements. It has been found that these unexpected vapor emissions result when the wind causes a positive differential pressure between the leeward and the windward sides of the floating roof tank so as to cause air to enter through a gap or other defect in the sealing apparatus on the leeward side of the tank and sweep vapors of the stored liquid through an annular vapor space around the circumference of the floating roof and out through a gap or defect on the windward side of the tank into the atmosphere. The apparatus of this invention is designed to substantially inhibit or prevent such circumferential flow through the annular vapor space and thereby substantially reduce the vapor emissions which would otherwise result due to this circumferential flow.

Figure 1:
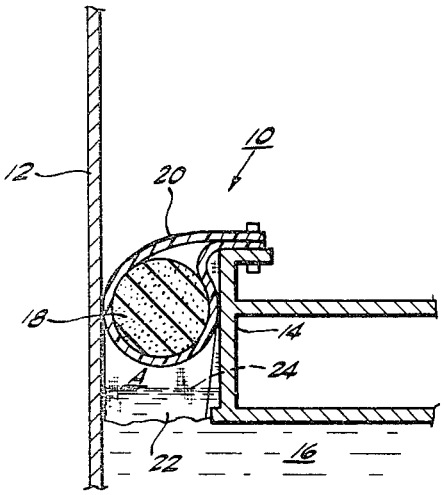
FIGS. 1 through 3 are partial elevational views in cross-section illustrating three embodiments of the sealing apparatus of this invention disposed between the floating roof and the wall of a floating roof tank.

Referring to FIG. 1, one embodiment of the sealing apparatus of this invention, shown generally as 10, is disposed between tank wall 12 and roof element 14 which is floating on a body of volatile liquid 16 contained by tank wall 12. Apparatus 10 includes (1) a primary sealing element comprised of toroidal element 18 disposed in wear resistant seal cover 20 fixedly coupled to roof element 14 and adapted to be compressed between roof element 14 and tank wall 12 so as to substantially completely seal the annular space around roof element 14 and (2) a plurality of curtain-like baffles 22 fixedly attached to the underside of the primary sealing element. The primary sealing element together with tank wall 12, roof element 14 and surface 24 of liquid body 16 define annular vapor space A containing vapors from the stored volatile liquid. In the absence of baffles 22, these vapors would be free to circulate through vapor space A around the circumference of roof element 14. However, baffles 22 are adapted to substantially inhibit or prevent fluid flow through vapor space A past baffle 22. Preferably baffle 22 is a flexible, vertically oriented curtain extending downwardly from the primary seal to a point below liquid surface 24, and extending radially outwardly from roof element 14 to tank wall 12. Baffle 22 is preferably adapted by its attachment to the primary sealing element to be automatically positioned across vapor space A as the primary sealing element adjusts itself to varying distances between roof element 14 and tank wall 12.

Figure 2:
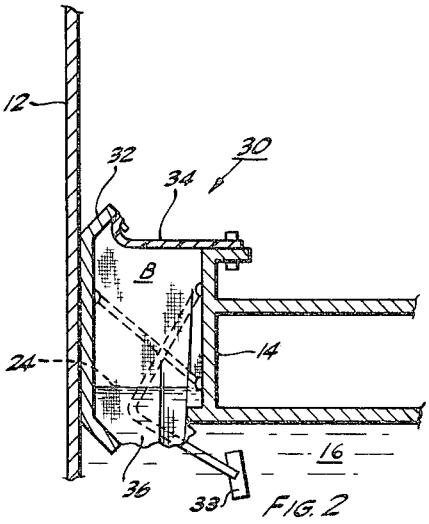

FIG. 2 illustrates another embodiment of the sealing apparatus of this invention, shown generally as 30. Apparatus 30 includes (1) shoe plate 32 coupled to roof element 14 and adapted to be yieldably urged outwardly against tank wall 12 by conventional means, such as pantagraph hanger 33, (2) wear-resistant seal cover 34 fluid-tightly coupled to roof element 14 and shoe plate 32, and (3) a plurality of curtain-like baffles 36 fixedly attached to shoe plate 32, roof element 14 and seal cover 34 and adapted to substantially inhibit or prevent fluid flow through annular vapor space B defined by shoe plate 32, seal cover 34, roof element 14 and liquid surface 24. Seal cover 34 substantially completely seals the annular space between shoe plates 32 and roof element 14 around the entire circumference of roof element 14 so as to, in the absence of defects, prohibit direct fluid communication between vapor space B and the atmosphere.

The sealing apparatus illustrated in FIGS. 1 and 2 can be used alone or in combination with a secondary seal, such as a secondary wiper seal or a secondary toroidal seal (not shown). Three or more sealing elements may also be employed. Typically one annular vapor space through which vapors can circulate will be defined for each sealing element employed. For example, a first vapor space is defined between the primary sealing element and the body of volatile liquid, a second vapor space is defined between the primary and secondary sealing elements, and so on. While it is preferred to have baffles traversing each such annular vapor space, even the use of baffles in less than all of the vapor spaces will result in reduced vapor emissions. Thus it is within the scope of this invention to have two or more sealing elements, and baffles in only one of the two or more annular vapor spaces defined by these sealing elements.

Figure 3:
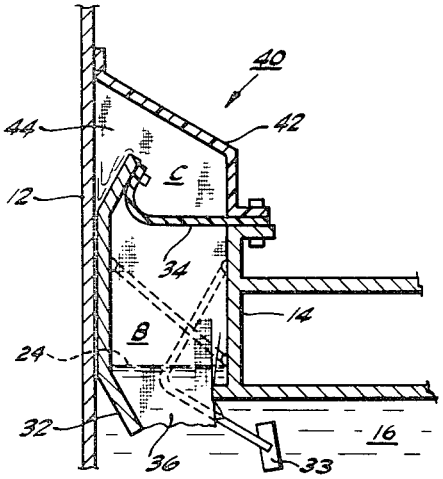

FIG. 3 illustrates a preferred embodiment of the sealing apparatus of this invention, shown generally as 40, having a primary sealing element, a secondary sealing element and baffles traversing each of the first and second vapor spaces defined by the sealing elements. More specifically apparatus 40 includes (1) shoe plate 32, seal cover 34 and baffles 36 as described above with respect to FIG. 2, (2) secondary wiper seal 42 fixedly coupled to roof element 14 and adapted to be yieldably urged against tank wall 12 independently from shoe plate 32, and (3) a plurality of curtain-like baffles 44 fixedly attached to the underside of wiper seal 42 and adapted to substantially inhibit or prevent fluid flow through annular vapor space C defined by wiper seal 42, seal cover 34 and tank wall 12.

Thus the apparatus of this invention includes (1) a sealing element which can be any conventional primary sealing device, such as a toroidal-type seal or a shoe-type seal, or can be both a primary sealing device and a secondary sealing device, and (2) a plurality of baffles disposed in one or more of the annular vapor spaces between the sealing element(s) and the body of stored liquid.

Figure 4:
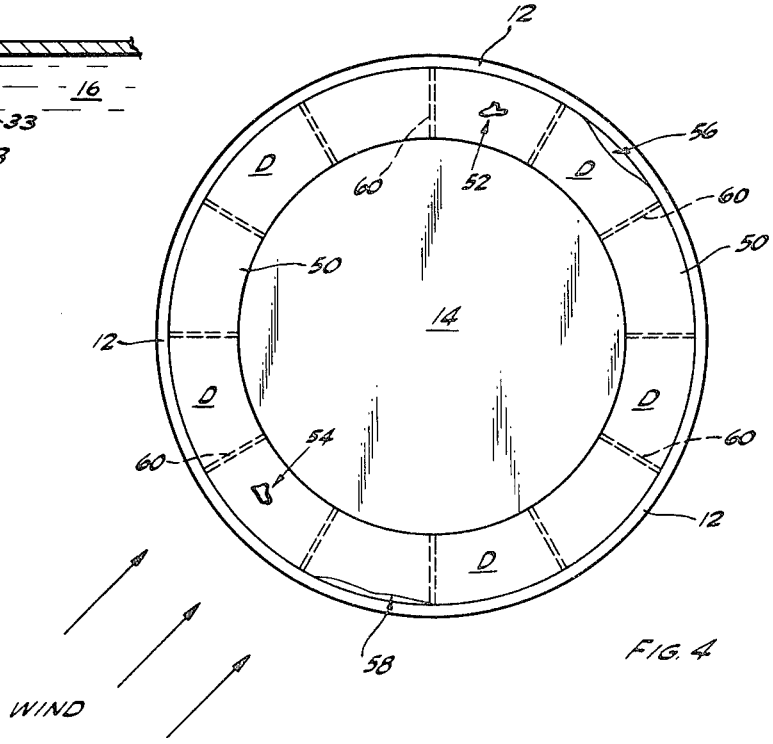
FIG. 4 is a plan view of a floating roof tank illustrating an embodiment of the sealing apparatus of this invention.

The function of the apparatus of this invention is best explained by reference to FIG. 4. Primary sealing element 50 is fixedly coupled to roof element 14 and is yieldably urged against tank wall 12 thereby defining an annular vapor space D between sealing element 50, the body of volatile liquid (not shown), roof element 14 and tank wall 12. For the purpose of illustration, sealing element 50 is shown with defects 52 and 54, such as a puncture or tear in seal cover 34 of FIG. 2, and gaps 56 and 58, such as a gap between seal cover 20 and tank wall 12 in FIG. 1.

In the absence of baffles 60, wind blowing across the top of the floating roof tank in the direction illustrated results in a decreased pressure adjacent the windward side of tank wall 12 and an increased pressure adjacent the leeward side of tank wall 12 with the result that air enters through defect 52 (or gap 56) into vapor space D and sweeps valuable vapors through vapor space D and out defect 54 (or gap 58). In this manner, even relatively small defects or gaps in primary seal 50 can result in significant vapor emissions. In order to substantially reduce or eliminate such emissions, the apparatus of this invention provides a plurality of baffles 60 at spaced intervals around the perimeter of roof element 14. Baffles 60 serve to divide vapor space D into a plurality of smaller arcuate vapor spaces, with fluid flow between adjacent vapor spaces being substantially inhibited or, preferably, prevented. In this manner, the sealing apparatus of this invention avoids vapor emissions caused by the wind sweeping unimpeded through vapor space D. Thus even the presence of defects 52 and 54 (or gaps 56 and 58) in the sealing element of the apparatus of this invention would not result in the significant vapor emissions observed with the prior art seals.

While any number of baffles 60 can be provided to reduce vapor emissions, typically between about 4 and about 100 baffles will be provided depending upon the size of the tank. Preferably between about 10 and about 40 baffles are provided to prohibit flow through each annular vapor space, with the baffles being evenly spaced about the perimeter of the floating roof so as to divide the annular vapor space into between about 10 and about 40 substantially fluid-tightly isolated spaces, each of which comprises between about 2.5 and about 10 percent of the volume of the total annular vapor space.

The baffles preferably comprise a flexible, vapor-impermeable material which is resistant to abrasion and to decomposition by contact with the volatile liquid and vapors with which it will be contacted. Suitable materials include synthetic rubber, urethane-coated nylon fabric and fabrics coated with synthetic rubber. The thickness of the baffle is not critical but rather is a matter of choice. Suitable baffle material is available from the General American Transportation Company of Chicago, Illinois and others.

The baffles can be attached to the associated sealing element and the floating roof by any convenient means. For example the baffle can be glued or riveted to the seal cover of the toroidal or shoe-type seal, and can be riveted to the side of the floating roof element. Other suitable fastening devices are known to the skilled artisan.

The sealing element employed in the apparatus of this invention is preferably a primary sealing element which substantially completely covers the annular space between the floating roof and the tank wall, i.e., the preferred sealing element is one which, in the absence of accidental gaps or defects, substantially eliminates any direct fluid communication between the stored volatile liquid and the atmosphere. Accordingly sealing elements which are designed with openings allowing direct fluid communication between the stored liquid and the atmosphere, such as the sealing elements disclosed in U.S. Pat. Nos. 1,775,758 to George and 2,563,016 to Feild, are not suitable for use in the apparatus of this invention. Sealing elements having no defects, gaps or other openings are particularly preferred.

While particular embodiments of the invention have been described, it will be understood, of course, that the invention is not limited thereto since many obvious modifications can be made and it is intended to include within this invention any such modification as will fall within the scope of the appended claims.

Having now described the invention, I claim:

1. An apparatus for reducing vapor emissions to the atmosphere through the annular space between a floating roof and the wall of a floating roof tank which contains a body of volatile liquid, said apparatus comprising:

first sealing means fixedly coupled to said floating roof and adapted to be yieldably urged against said wall so as to prohibit direct fluid communication through said annular space between said body of volatile liquid and the atmosphere in the absence of accidental defects or gaps in said first sealing means; and a first plurality of baffles coupled to said first sealing means and disposed between said first sealing means and said body of volatile liquid in a first annular vapor space around the circumference of said floating roof, said first plurality of baffles being adapted to substantially inhibit fluid flow through said first vapor space.

2. The apparatus defined in claim 1 wherein said first sealing means comprises a plurality of shoe plates; means for yieldably urging said shoe plates outwardly against said wall; and cover means coupled to said shoe plates and said floating roof, said cover means being adapted to substantially fluid-tightly seal from the atmosphere the entire annular space between said shoe plates and said floating roof.

3. The apparatus defined in claim 1 further comprising a second sealing means coupled to said floating roof and adapted to be yieldably urged against said wall so as to substantially prohibit direct fluid communication between the atmosphere and a second annular vapor space defined by said wall and said first and second sealing means.

4. The apparatus defined in claim 3 further comprising a second plurality of baffles coupled to said second sealing means and disposed in said second vapor space between said first and second sealing means so as to substantially inhibit fluid flow through said second vapor space.

5. The apparatus defined in claim 1 wherein said first sealing means is a toroidal seal.

6. An apparatus for reducing vapor emissions to the atmosphere through the annular space between a floating roof and the wall of a floating roof tank which contains a body of volatile liquid, said apparatus comprising:

a plurality of shoe plates spaced evenly about and coupled to said floating roof, said shoe plates being adapted to be yieldably urged against said wall;

means coupled to said floating roof and said shoe plates for yieldably urging said shoe plates against said wall;

cover means coupled to said floating roof and said shoe plates, said cover means being adapted in the absence of accidental defects therein to fluid-tightly seal from the atmosphere the entire annular space between said shoe plates and said floating roof; and a first plurality of flexible baffles, each of which is coupled to said floating roof, said shoe plates and said cover means and is disposed in a first vapor space defined by the surface of said body of volatile liquid, said shoe plates, said cover means and said floating roof, and said first plurality of baffles being positioned traversely within said first vapor space so as to substantially inhibit fluid flow through said first vapor space.

7. The apparatus defined in claim 6 wherein said flexible baffles are vertically-oriented, curtain-like baffles extending from said cover means to a point below the surface of said body of volatile liquid and extending radially outwardly from said floating roof to said shoe plates.

8. The apparatus defined in claim 6 further comprising secondary sealing means coupled to said floating roof and adapted to be yieldably urged against said wall so as to substantially prohibit direct fluid communication between the atmosphere and a second annular vapor space defined by said wall, said cover means and said secondary sealing means; and means for yieldably urging said secondary sealing means against said wall.

9. The apparatus defined in claim 8 further comprising a second plurality of baffles coupled to said secondary sealing means and disposed in said second vapor space between said wall, said cover means and said secondary sealing means so as to substantially inhibit fluid flow through said second vapor space.

10. The apparatus defined in claim 6 wherein said first plurality of baffles comprises between about 10 and about 40 baffles spaced about the circumference of said floating roof so as to divide said first annular space into between about 10 and about 40 substantially fluid-tightly isolated vapor spaces, each of which comprises between about 2.5 and about 10 percent of the volume of said first vapor space.

11. An apparatus for reducing vapor emissions to the atmosphere through the annular space between a floating roof and wall of a floating roof tank which contains a body of volatile liquid, said apparatus comprising:

toroidal sealing means fixedly coupled to said floating roof and adapted to be compressed between said roof and said wall so as to prohibit direct fluid communication through said annular space between said body of volatile liquid and the atmosphere in the absence of accidental defects or gaps in said toroidal sealing means; and a first plurality of flexible baffles each of which is coupled to said floating roof and said toroidal sealing means and is disposed in a first vapor space defined by the surface of said body of volatile liquid, said wall, said toroidal sealing means and said floating roof, said first plurality of baffles being positioned traversely within said first vapor space so as to substantially inhibit fluid flow through said first vapor space.

12. The apparatus defined in claim 11 wherein said flexible baffles are vertically-oriented, curtain-like baffles extending from said toroidal sealing means to a point below the surface of said body of volatile liquid and extending radially outwardly from said floating roof to the outermost extension of said toroidal sealing means.

13. The apparatus defined in claim 11 further comprising secondary sealing means coupled to said floating roof and adapted to be yieldably urged against said wall so as to substantialy prohibit direct fluid communication between the atmosphere and a second annular vapor space defined by said wall, said toroidal sealing means and said secondary sealing means; and means for yieldably urging said secondary sealing means against said wall.

14. The apparatus defined in claim 13 further comprising a second plurality of baffles coupled to said secondary sealing means and disposed in said second vapor space between said wall, said toroidal sealing means and said secondary sealing means so as to substantially inhibit fluid flow through said second vapor space.

15. The apparatus defined in claim 11 wherein said first plurality of baffles comprises between about 10 and about 40 baffles spaced about the circumference of said floating roof so as to divide said first annular space into between about 10 and about 40 substantially fluid-tightly isolated vapor spaces, each of which comprises between about 2.5 and about 10 percent of the volume of said first vapor space.

* * * * *

UNITED STATES PATENT AND TRADEMARK OFFICE

CERTIFICATE OF CORRECTION

PATENT NO. : 4,258,858

DATED : March 31, 1981

INVENTOR(S) : ROBERT L. RUSSELL

It is certified that error appears in the above-identified patent and that said Letters Patent are hereby corrected as shown below:

On the cover sheet, in first column, insert immediately below "[76] Inventor:"

--[73] Assignee: Union Oil Company of California
Brea, Calif.--

Signed and Sealed this

*Eleventh* Day of *August 1981*

[SEAL]

*Attest:*

GERALD J. MOSSINGHOFF

*Attesting Officer*

*Commissioner of Patents and Trademarks*